US007968142B2

(12) United States Patent
Kamata et al.

(10) Patent No.: US 7,968,142 B2
(45) Date of Patent: Jun. 28, 2011

(54) METHOD AND APPARATUS FOR COLORING ELECTRIC WIRE

(75) Inventors: Takeshi Kamata, Shizuoka (JP); Keigo Sugimura, Shizuoka (JP); Sei Saito, Shizuoka (JP); Kiyoshi Yagi, Shizuoka (JP)

(73) Assignee: Yazaki Corporation, Tokyo (JP)

( * ) Notice: Subject to any disclaimer, the term of this patent is extended or adjusted under 35 U.S.C. 154(b) by 934 days.

(21) Appl. No.: 10/872,547

(22) Filed: Jun. 22, 2004

(65) Prior Publication Data

US 2004/0265485 A1 Dec. 30, 2004

(30) Foreign Application Priority Data

Jun. 24, 2003 (JP) ..... 2003-179717

(51) Int. Cl.
*B05D 5/12* (2006.01)
*B05D 5/00* (2006.01)

(52) U.S. Cl. ..... 427/117; 427/286; 427/422

(58) Field of Classification Search ..... 427/117, 427/286, 422

See application file for complete search history.

(56) References Cited

U.S. PATENT DOCUMENTS

| | | | | | |
|---|---|---|---|---|---|
| 2,900,710 | A | * | 8/1959 | Hurat et al. | 72/46 |
| 3,638,612 | A | * | 2/1972 | Haise et al. | 118/625 |
| 4,103,827 | A | * | 8/1978 | Kumazawa | 239/8 |
| 4,457,258 | A | * | 7/1984 | Cocks | 118/694 |
| 4,503,437 | A | * | 3/1985 | Katzschner | 347/43 |
| 4,877,645 | A | * | 10/1989 | Bleich et al. | 427/117 |
| 5,032,850 | A | * | 7/1991 | Andeen et al. | 347/15 |
| 5,113,198 | A | * | 5/1992 | Nishikawa et al. | 347/21 |
| 5,153,025 | A | * | 10/1992 | Klebl et al. | 427/118 |
| 5,444,466 | A | * | 8/1995 | Smyczek et al. | 347/4 |

FOREIGN PATENT DOCUMENTS

| | | | |
|---|---|---|---|
| EP | 1324355 | * | 2/2003 |
| GB | 1 290 415 | | 9/1972 |
| GB | 1 423 324 | | 2/1976 |
| JP | 02-270221 | | 11/1990 |
| JP | 5-111947 | | 5/1993 |
| JP | 6-119833 | | 4/1994 |
| JP | 06-064331 | | 9/1994 |
| JP | 9-92056 | | 4/1997 |
| JP | 10-031918 | * | 2/1998 |
| JP | 2001-256721 | | 9/2001 |
| JP | 2002-233729 | | 8/2002 |
| JP | 2002-310557 | | 10/2002 |

OTHER PUBLICATIONS

European Search Report dated May 11, 2005 (3 pages).

* cited by examiner

*Primary Examiner* — Brian K Talbot
(74) *Attorney, Agent, or Firm* — Kratz, Quintos & Hanson, LLP

(57) ABSTRACT

A coloring apparatus for coloring an electric wire colors the wire spouts a liquid coloring agent, including a coloring material and a solvent, toward an outer surface of the wire with a specific amount thereof at a time. The coloring apparatus includes a coloring agent supply source for receiving the coloring agent, a coloring nozzle and a heater. The coloring nozzle spouts the coloring agent of the coloring agent supply source. The heater includes a heating bath and a hot air inlet. The heating bath receives the coloring nozzle. The heating bath allows the coloring nozzle to spout the coloring agent. The hot air inlet supplies hot air into the heating bath to heat the coloring agent supply source. The heater heats the coloring agent to a range lower than a boiling point of the solvent by the hot air inlet supplying the hot air into the heating bath.

4 Claims, 4 Drawing Sheets

METHOD AND APPARATUS FOR COLORING ELECTRIC WIRE

The priority application Number Japanese Patent Application No. 2003-179717 upon which this patent application is based is hereby incorporated by reference.

FIELD OF THE INVENTION

The present invention relates to a method and an apparatus for coloring an electric wire that includes an electrically conductive core wire and an electrically insulating coating for coating the core wire.

DESCRIPTION OF THE RELATED ART

Various electronic devices are mounted on a motor vehicle as a mobile unit. Therefore, the motor vehicle is provided with a wiring harness for transmitting power from a power source and control signals from a computer to the electronic devices. The wiring harness includes a plurality of electric wires and connectors attached to an end of the wires.

The wire includes an electrically conductive core wire and a coating made of insulating synthetic resin, which coats the core wire. The wire is a so-called coated wire. A connector includes a terminal fitting and a connector housing that receives the terminal fitting therein. The terminal fitting, consisting of electrically conductive sheet metal or the like, is attached to an end of the wire and electrically connected to the core wire of the wire. The connector housing made of electrically insulating synthetic resin is formed in a box-shape. When the connector housing is connected to the electronic devices, each wires is connected to the corresponding electronic device through the terminal fitting, thereby the wiring harness transmits the desired electric power and signals to the electronic devices.

When the wiring harness is assembled, first the wire is cut into a specific length and then the terminal fitting is attached to an end of the wire after removing the coating near the end. A wire is connected to another wire according to the need. Afterward, the terminal fitting is inserted into the connector housing, thereby assembling the wiring harness.

The wire of the wiring harness must be distinguished in terms of the size of the core wire, the material of the coating (concerning with alteration in the materials depending upon heat-resisting property) and a purpose of use. The purpose of use means, for example, an air bag, antilock brake system (ABS) control signal such as speed data, and system in a motor vehicle in which the wire is used, such as a power transmission system.

The coating of the wire used in the wiring harness has been colored to a desired color by mixing a coloring agent of the desired color with synthetic resin which constitutes the coating when the synthetic resin of the coating is applied onto the circumference of the core wire by extrusion (for example, see Japanese Patent Application Laid-Open No. H5-111947, Japanese Patent Application Laid-Open No. H6-119833, and Japanese Patent Application Laid-Open No. H9-92056).

In this case, when a color of an outer surface of the wire is altered, it is necessary to halt an operation of an extrusion apparatus that performs the extrusion-coating. That is, whenever the color of the wire is changed, it is necessary to halt an operation of an extrusion apparatus causing increasing in a time period and labor hour required for the production of the wire and deteriorating in the productivity of the wire.

Alternatively, the coloring agent to be mixed has been replaced while the extrusion apparatus is performing the extrusion-coating. In such a case, right after changing the color of the coloring agent, a wire, in the color of the synthetic resin of which a coloring agent before the replacement and a coloring agent after the replacement are mixed, has been inevitably manufactured, causing the deterioration in the yield of the material of the wire.

In order to prevent the deterioration in the productivity of the wire and in the yield of the material of the wire, the present applicant proposed a method, in which monochromatic wire is produced, then the outer surface of the wire is colored with a desired color according to the need, thereby assembling a wiring harness (see Japanese Patent Application No. 2001-256721). Alternatively, the present applicant proposed an apparatus for coloring a wire, by which upon coloring a monochromatic wire, a liquid coloring agent is spouted toward the outer surface of the wire with a specific amount thereof at a time so as to allow the liquid drop of the coloring agent to adhere to the outer surface of the wire, thereby coloring the wire with the desired color (see Japanese Patent Application No. 2002-233729).

The coloring apparatus described above includes a coloring nozzle that spouts the liquid coloring agent toward the outer surface of the wire with a specific amount thereof at a time. The coloring nozzle includes a receiver for receiving the coloring agent under pressure, a cylindrical nozzle that communicates with the receiver and guides the coloring agent therethrough, and a valve element provided in the receiver, which can approach and leave a base end of the coloring nozzle.

In the coloring apparatus for coloring the wire, the coloring agent is spouted from an end of the nozzle toward the outer surface of the wire in a state that the valve element leaves away from the nozzle.

Further, in the coloring apparatus for coloring the wire, the valve element approaches the nozzle so as to come in contact with the nozzle, thereby halting the spouting of the coloring agent from an end of the nozzle toward the outer surface of the wire.

As for the coloring apparatus, in which the coloring agent is spouted toward the outer surface of the wire with a specific amount thereof at a time, it is desirable that the coloring apparatus should be mounted on various apparatuses for assembling a wiring harness as described above to be used together with said apparatuses. One of said apparatuses is, for example, an apparatus for cutting a wire into a specific length and then attaching a terminal fitting to an end of the wire.

In the apparatuses, the wire is subjected to various processes, while being moved in a longitudinal direction of the wire. Therefore, it is desirable that the coloring agent, being spouted and adhering to the outer surface of the wire, is dried quickly in the coloring apparatus. If the coloring agent is not dried quickly, the coloring agent may adhere to such as a roller of the various apparatuses to move the wire, and then adhere to the wire again. This is, of course, undesirable, because the outer surface of the wire is contaminated. At worst, the wires may be hard to be identified.

Therefore, the object of the present invention is to provide a method and an apparatus for coloring an electric wire, which can color the electric wire without contaminating it.

In order to solve the above problems and to attain the above object, according to the present invention, there is provided a method of coloring an electric wire comprising the step of:

spouting a liquid coloring agent including a coloring material and a solvent toward an outer surface of the electric wire with a specific amount thereof at a time so as to allow a liquid drop of the coloring agent to adhere to the outer surface of the electric wire, whereby said coloring agent is previously heated up to a range lower than a boiling point of the solvent, and then spouted to the outer surface of the electric wire.

According to the present invention, preferably, there is provided the method of coloring an electric wire, wherein a receiver for receiving the coloring agent therein is heated for heating the coloring agent to a range lower than the boiling point of the solvent, wherein the coloring agent is spouted through a nozzle from the receiver toward the outer surface of the electric wire.

According to the present invention, preferably, there is provided the method of coloring an electric wire, wherein the nozzle is kept at a room temperature.

According to the present invention, preferably, there is provided the method of coloring an electric wire, wherein the nozzle is cooled.

According to the present invention, there is provided an apparatus for coloring an electric wire comprising:

a receiver for receiving therein a liquid coloring agent including a coloring material and a solvent;

a nozzle for spouting the coloring agent toward an outer surface of an electric wire; and a heater for heating the receiver to a range lower than a boiling point of the solvent, whereby said apparatus spouts the coloring agent toward the outer surface of the electric wire with a specific amount thereof at a time so as to allow a liquid drop of the coloring agent to adhere to the outer surface of the electric wire.

According to the present invention, preferably, there is provided the apparatus for coloring an electric wire, further comprising a thermostat for keeping the nozzle at a room temperature.

According to the present invention, preferably, there is provided the apparatus for coloring an electric wire, further comprising a means for cooling the nozzle.

According to the present invention described above, the outer surface of the wire is colored with the heated coloring agent. Therefore, the coloring agent adhering to the outer surface of the electric wire is quickly dried. Further, since the coloring agent is heated up to a range lower than the boiling point of the solvent of the coloring agent, said solvent is hard to evaporate.

In this specification, the coloring agent means a liquid substance, in which a coloring material (organic substance for use in industry) is dissolved and dispersed in water or other solvent. The organic substance described above is a dye or a pigment (most of them being organic substances and synthetic substances). Sometimes, a dye is used as a pigment and a pigment is used as a dye. As a concrete example, the coloring agent may be a coloring liquid or coating material. The coloring liquid is a liquid, in which a dye, as the coloring material, is dissolved or dispersed in a solvent. The coating material is a material, in which a pigment, as the coloring material, is dispersed in a liquid dispersion as the solvent. When the outer surface of the wire is colored with a coloring liquid, the dye permeates into the coating of the wire. When the outer surface of the wire is colored with a coating material, the pigment adheres to the outer surface without permeating into the coating of the wire. In the specification, "to color the outer surface of the wire" means to dye a part of the outer surface of the coating of the wire with a dye or to coat a part of the outer surface of the coating of the wire with a pigment.

Preferably, the solvent and liquid dispersion have an affinity to the synthetic resin that constitutes the coating in order to securely permeate the dye into the coating or to allow the pigment to securely adhere to the outer surface of the coating.

In this specification, "spouting" means that the liquid coloring agent in a state of the liquid drop is ejected vigorously from the coloring nozzle toward the outer surface of the wire.

According to the present invention as described above, the receiver is heated and the coloring agent is spouted through the nozzle. Therefore, the nozzle is not heated and the temperature of the coloring agent is reliably kept at a range lower than the boiling point of the solvent.

According to the present invention as described above, since the nozzle is kept at a room temperature, the temperature of the coloring agent is reliably kept at a range lower than the boiling point of the solvent.

According to the present invention as described above, since the nozzle is cooled, the temperature of the coloring agent is reliably kept at a range lower than the boiling point of the solvent.

According to the present invention as described above, the outer surface of the electric wire is colored with the heated coloring agent. Therefore, the coloring agent adhering to the outer surface of the wire is quickly dried. Further, the heater heats the receiver. Therefore, the nozzle is not heated and the coloring agent is reliably kept at a range lower than the boiling point of the solvent. Therefore, the coloring agent is hard to evaporate.

According to the present invention as described above, since the thermostat keeps the nozzle at a room temperature, the temperature of the coloring agent is reliably kept at arrange lower than the boiling point of the solvent.

According to the present invention as described above, since the cooling means cools the nozzle, the temperature of the coloring agent is reliably kept at a range lower than the boiling point of the solvent.

PREFERRED EMBODIMENTS OF THE INVENTION

Figure 1:
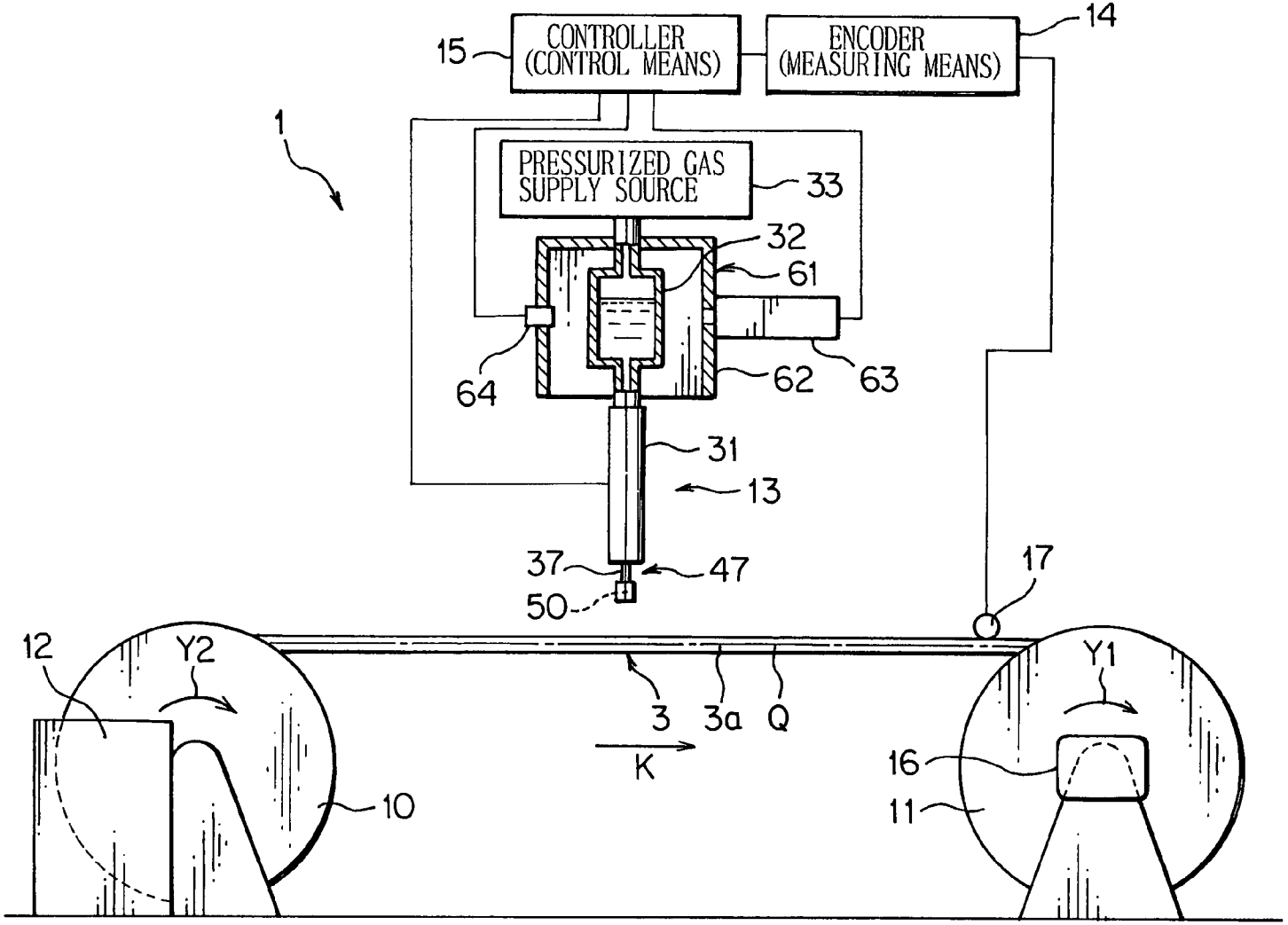
FIG. 1 is an explanatory view showing a structure of an apparatus for coloring an electric wire according to a first embodiment of the present invention.

In the following, an apparatus 1 for coloring an electric wire (hereinafter referred to as a coloring apparatus 1) according to a first preferred embodiment of the present invention will be explained with reference to FIGS. 1-3. The coloring apparatus 1 shown in FIG. 1 and so on is an apparatus for forming a mark 6 on a part of an outer surface 3*a* of an electric wire 3 (i.e. wire 3). That is, the coloring apparatus 1 colors the outer surface 3*a* of the wire 3, i.e. performs marking on the outer surface 3*a* of the wire 3.

Figure 2A:
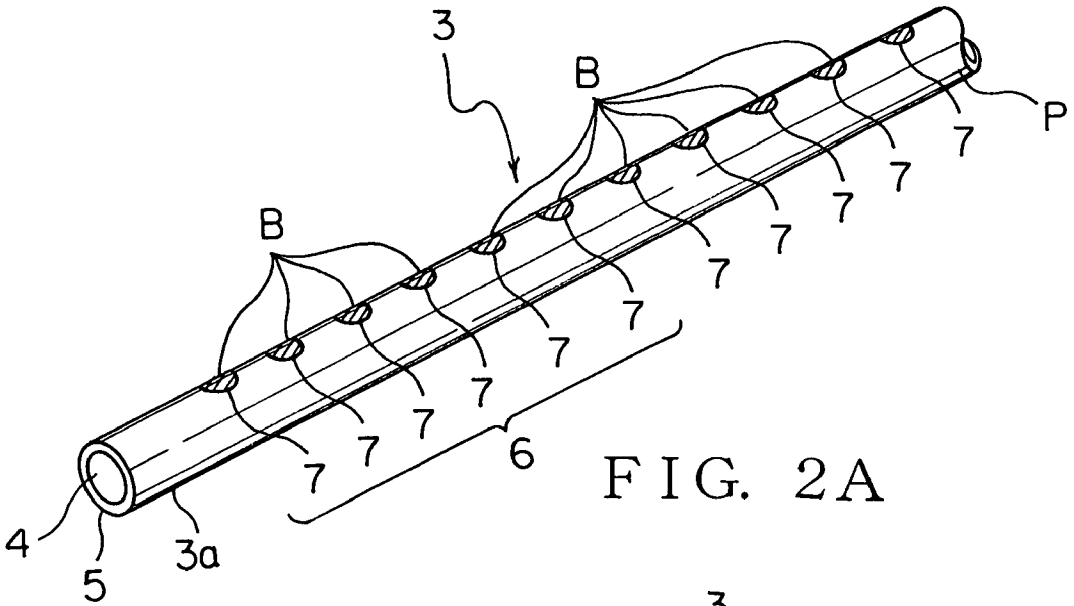
FIG. 2A is a perspective view showing an electric wire colored by the apparatus shown in FIG. 1.

An electric wire 3 constitutes a wiring harness to be mounted on a motor vehicle or the like as a mobile unit. As shown in FIG. 2A and so on, the wire 3 includes an electrically conductive core wire 4 and an electrically insulating coating 5. A plurality of element wires are bundled up to form the core wire 4. Each element wire of the core wire 4 is made of electrically conductive metal. The core wire 4 may be constituted by a single element wire. The coating 5 is made of synthetic resin such as polyvinyl chloride (PVC). The coating 5 coats the core wire 4. Therefore, the outer surface 3*a* of the wire 3 means an outer surface of the coating 5.

The coating 5 has a monochrome color P. A desired coloring agent may be mixed with the synthetic resin of the coating 5 so as to make the color of the outer surface 3*a* of the wire 3 be a monochrome color P, or alternatively, the monochrome color P may be set as the color of the synthetic resin itself without adding a coloring agent to the synthetic resin of the coating 5. In the latter case, the outer surface 3*a* of the wire 3 is not colored, i.e. the coating 5 is not colored.

Figure 2B:
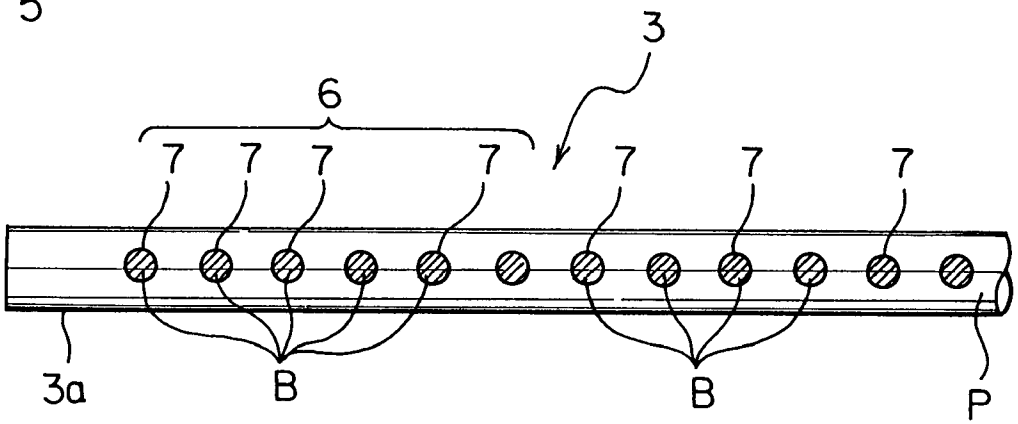
FIG. 2B is a plane view showing the electric wire shown in FIG. 2A.

On the outer surface 3*a* of the wire 3, there are formed a mark 6 consisting of a plurality of spots 7. The spot 7 has a color B (indicated with parallel oblique lines in FIGS. 3A and 3B), which is different from the monochrome color P. The spot 7 is round in the plan view as shown in FIG. 2B. A plurality of the spots 7 are arranged in the longitudinal direction of the wire 3 according to a predetermined pattern. The distance between the centers of the spots 7 situated adjacently to each other is predetermined.

A plurality of the wires 3 are bundled and connectors are attached to respective ends of the wires 3, thereby constructing a wiring harness. The connectors are coupled with respective mating connectors of various electronic instruments in a motor vehicle and so on, thereby the wiring harness (i.e. the wires 3) transmits various signals and electric power to the electronic instruments.

The wires 3 are distinguishable from one another by changing a color B of each spot 7 of the mark 6. In the figure, as an example, the color B of all of the spots 7 of the wire 3 is set the same, however, the color B may be changed for the respective spots 7 according to the need. The color B is used to distinguish types of the wires in a wiring harness or systems. That is, the color B is used to distinguish the types of the wires in the wiring harness or the purposes of use.

As shown in FIG. 1, the coloring apparatus 1 includes a feed reel 10 as feed means, winding reel 11 as winding means, brake 12 as stretch means, coloring unit 13, encoder 14 as measuring means, and controller 15 as control means. The feed reel 10 and winding reel 11 are placed rotatably on a floor or the like in a plant. The feed reel 10 and winding reel 11 are arranged having a distance therebetween.

The feed reel 10 winds up the wire 3 and forwards the wire 3 toward the winding reel 11. The winding reel 11 receives the wire 3 forwarded from the feed reel 10. The winding reel 11 is provided with a motor 16 or the like and rotates along an arrow Y1 shown in FIG. 1 with a drive force by the motor 16.

The feed reel 10 is not provided with a motor and is rotated along an arrow Y2 shown in FIG. 1 by being pulled by the wire 3 when the winding reel 11 rotates along the arrow Y1 shown in FIG. 1 so as to wind up the wire 3. The direction of the arrow Y1 is the same as that of the arrow Y2.

When the motor 16 rotates and drives the winding reel 11 to rotate along the arrow Y1, the wire 3 is forwarded in the longitudinal direction of the wire 3, that is, in the direction of the axis Q of the wire 3, i.e. in the direction of an arrow K shown in FIG. 1. The arrow K indicates one direction.

The brake 12 is fixed to both the feed reel 10 and the floor. The brake 12 causes friction between the brake 12 and the feed reel 10. When the feed reel 10 is rotated, the brake 12 gives a frictional force to the feed reel 10 so as to restrict the rotation of the feed reel 10. That is, the brake 10 tends to make the number of revolutions of the feed reel 10 be smaller than that of the winding reel 11.

That is, the brake 12 gives a tension to the wire 3, which is stretched between the feed reel 10 and the winding reel 11, along the longitudinal direction of the wire 3. That is, the brake 12 stretches the wire 3 giving the tension to the wire 3 along the longitudinal direction of the wire 3.

As shown in FIG. 1, the coloring unit 13 is arranged between the feed reel 10 and the winding reel 11. The coloring unit 13 includes a coloring nozzle 31 as the nozzle (means for spouting the coloring agent), a coloring agent supply source 32 as the receiver, a pressurized gas supply source 33, and a heater 61 as the heater.

The coloring nozzle 31 spouts the liquid coloring agent fed from the coloring agent supply source 32 toward the outer surface 3*a* of the wire 3 with a specific amount of the coloring agent at a time. The coloring nozzle 31 allows the spouted liquid drop or drops to adhere to outer surface 3*a* of the wire 3 so as to color (or mark) at least a part of the outer surface 3*a* of the wire 3.

The coloring agent means a liquid substance, in which a coloring material (organic substance for use in industry) is dissolved and dispersed in water or other solvent. Namely, the coloring agent-consists of a coloring material and a solvent. The organic substance (coloring material) described above is a dye or a pigment (most of them being organic substances and synthetic substances). Sometimes, a dye is used as a pigment and a pigment is used as a dye. As a concrete example, the coloring agent is a coloring liquid or coating material.

The coloring liquid is a liquid, in which a dye is dissolved or dispersed in a solvent. The coating material is a material, in which a pigment is dispersed in a liquid dispersion. When the coloring liquid adheres to the outer surface 3*a* of the wire 3, the dye permeates into the coating 5. When the coating material adheres to the outer surface 3*a* of the wire 3, the pigment adheres to the outer surface 3*a* without permeating into the coating 5. That is, the coloring unit 13 dyes a part of the outer surface 3*a* of the wire 3 with a dye or coats a part of the outer surface 3*a* of the wire 3 with a pigment. That is, "to color the outer surface 3*a* of the wire 3" means to dye a part of the outer surface 3*a* of the wire 3 with a dye or to coat a part of the outer surface 3*a* of the wire 3 with a pigment.

Preferably, the solvent and liquid dispersion have an affinity to the synthetic resin that constitutes the coating 5 in order to securely permeate the dye into the coating 5 or to allow the pigment to securely adhere to the outer surface 3*a*.

The "spouting" described above means that the liquid coloring agent in a state of the liquid drop is ejected vigorously from the coloring nozzle 31 toward the outer surface 3*a* of the wire 3.

In this embodiment, the above described coloring liquid is used as the coloring agent, and Acetone is used as the solvent.

The coloring agent supply source 32 stores the liquid coloring agent and is associated with the coloring nozzle 31. The coloring agent supply source 32 supplies the coloring agent into the inlet pipe 36 of the corresponding coloring nozzle 31.

The pressurized gas supply source 33 supplies the pressurized gas into the coloring agent supply source 32. Then, when the valve element 44 of the coloring nozzle 31 leaves the base end 37*a* of the first nozzle 37, the coloring agent in the channel 39 spouts through the first nozzle 37 and the second nozzle 50.

The heater 61 includes, as shown in FIG. 1, a heating bath 62, a hot air inlet 63 and a temperature sensor 64. The heating bath 62 has a box-like shape with a bottom opening. The heating bath 62 receives the coloring agent supply source 32.

The hot air inlet 63 is attached to an outer wall of the heating bath 62, and supplies a hot air into the heating bath 62, namely, blowing the hot air into the heating bath 62.

The temperature sensor 64 is attached to an outer wall of the heating bath 62*a* and measures the temperature inside the heating bath 62. The temperature sensor 64 outputs the temperature data of the inside of the heating bath 62 to the controller 15.

When the temperature inside the heating bath 62 measured by the temperature sensor 64 is lower than a specific temperature, which is lower than the boiling point of the solvent of the coloring agent, the controller 15 commands the heater 61 to blow the hot air through the hot air inlet 63. When the temperature inside the heating bath 62 measured by the temperature sensor 64 is higher than a specific temperature around the boiling point of the solvent of the coloring agent, the controller 15 commands the heater 61 to stop blowing the hot air through the hot air inlet 63. Consequently, the temperature of the coloring agent is kept under the boiling point.

Since the heating bath 62 receives the coloring agent supply source 32 and the hot air is supplied through the hot air inlet 63, the heater 61 heats the coloring agent in the coloring agent supply source 32 in a range lower than the boiling point of the solvent.

According to a command of the controller 15, a current is supplied to the coil 40 in the coloring unit 13, so that the valve element 44 leaves the base end 37*a* of the first nozzle 37. Thereby, the coloring nozzle 31 spouts the coloring agent in the channel 39 of the coloring nozzle 31 toward the wire 3 with a specific amount thereof at a time.

In this case, the coloring agent is heated in a range lower than the boiling point of the solvent by heating the heating bath 62 of the heater 61. Then, the coloring agent heated in the coloring agent supply source 32 is spouted through the coloring nozzle 31 toward the outer surface 3*a* of the wire 3. Thus, the coloring unit 13 colors the outer surface 3*a* of the wire 3 with the heated coloring agent, and cools the coloring agent heated in the coloring agent supply source 32 by passing the coloring agent through the unheated coloring nozzle 31.

As shown in FIG. 1, the encoder 14 includes a pair of rotors 17. The rotor 17 is supported rotatably around the axis of the rotor 17. An outer circumferential surface of the rotor 17 comes in contact with the outer surface 3*a* of the wire 3, which is forwarded along the arrow K. When the core wire 4, i.e. the wire 3 is forwarded along the arrow K, the rotor 17 is rotated. The amount of the transfer of the wire 3 along the arrow K is proportional to the number of revolutions of the rotor 17.

The encoder 14 is linked to the controller 15. When the rotor 17 rotates by a specific angle, the encoder 14 outputs a pulse signal to the controller 15. That is, the encoder 14 measures an information corresponding to the amount of the transfer of the wire 3 along the arrow K and outputs the information to the controller 15. Normally, the encoder 14 outputs a pulse signal corresponding to the amount of the transfer of the wire 3 with the aid of the friction between the wire 3 and the rotor 17. However, in the event that the amount of the transfer of the wire 3 does not coincide with the number of the pulse due to a condition of the outer surface 3*a* of the wire 3, another speed information of the transfer of the wire 3 may be obtained from another position so that thus obtained speed information is subjected to feedback so as to allow the controller 15 to compare the both.

The controller 15 is a computer that includes a known RAM, ROM, CPU and so on. The controller 15, being linked to the motor 16 of the winding reel 11, encoder 14, coloring nozzle 31 and the pressurized gas supply source 33, controls actions of these so as to control the whole of the coloring apparatus 1.

The controller 15 stores a pattern of the mark 6 in advance. When the controller 15 receives a specific pulse signal from the encoder 14, namely, the information corresponding to the amount of the transfer of the wire 3, the controller 15 applies a current to the coil 40 of the selected coloring nozzle 31 as described above for a specific period of time so that the coloring agent is spouted from the coloring nozzle 31 toward the wire 3 with a specific amount of the coloring agent at a time. According to the pattern of the mark 6, the controller 15 shortens a time interval of the spouting of the coloring agent from the coloring nozzle 31 when the transfer speed of the wire 3 increases, while the controller 15 elongates a time interval of the spouting of the coloring agent from the coloring nozzle 31 when the transfer speed of the wire 3 decreases.

Thus, the controller 15 performs the coloring of the wire 3 according to the pattern stored in advance. The controller 15 makes the coloring nozzle 31 spout the coloring agent with a specific amount thereof at a time on the basis of the amount of the transfer of the wire 3 measured by the encoder 14.

The temperature inside the heating bath 62 measured by the temperature sensor 64 is outputted to the controller 15. When the temperature inside the heating bath 62 measured by the temperature sensor 64 is lower than the specific temperature, which is lower than the boiling point of the solvent of the coloring agent, the controller 15 commands the heater 61 to blow the hot air through the hot air inlet 63. When the temperature inside the heating bath 62 measured by the temperature sensor 64 is higher than a specific temperature around the boiling point of the solvent of the coloring agent, the controller 15 stops blowing the hot air through the hot air inlet 63. The controller 15 controls the blowing according to the temperature inside the heating bath 62 measured by the temperature sensor 64, so that the temperature inside the heating bath 62 is to be decreased under the boiling point of the solvent of the coloring agent.

When the coloring apparatus 1 forms the mark 6 on the outer surface 3*a* of the wire 3, first an end of the wire 3 wound by the feed reel 10 is wound on the winding reel 11.

Then, the motor 16 is driven so as to rotate the winding reel 11 along the arrow Y1 and to rotate the feed reel 10 along the arrow Y2, thereby the wire 3 is transferred from the feed reel 10 to the winding reel 11. Then, since the brake 12 has given the friction force to the feed reel 10, the wire 3 is stretched in a state that the wire 3 is provided with the tension. Further, the hot air is blown through the hot air inlet 63 into the heating bath 62 to heat the coloring agent in the heating bath 62, namely, in the coloring agent supply source 32 in a range lower than the boiling point of the solvent of the coloring agent.

Then, when the encoder 14 outputs a pulse signal of a specific sequence to the controller 15, the controller 15 applies a current to the coil 40 of the coloring nozzle 31 for a specific period of time with a specific time interval. Then, the coloring nozzle 31 spouts the coloring agent toward the outer surface 3*a* of the wire 3 with a specific amount of the heated coloring agent at a time. Before being spouted, the coloring agent is stirred by colliding with the end face 50*a* of the second nozzle 50.

Then, the solvent or the liquid dispersion evaporates from the coloring agent adhering to the outer surface 3*a* of the wire 3, thereby the outer surface 3*a* of the wire 3 is dyed with the dye or coated with the pigment. Thus, the wire 3 shown in FIGS. 2A and 2B, the outer surface 3*a* of which is provided with the mark 6, is obtained.

According to this embodiment, the outer surface 3*a* of the wire 3 is colored by the heated coloring agent. Therefore, the solvent of the coloring agent adhering to the outer surface 3*a* of the wire 3 evaporates quickly, so that the coloring agent is dried quickly. Therefore, the coloring agent is prevented from adhering the rollers to move the wire 3, or the winding reel 11 and the coloring agent adhering to the winding reel 11 is also prevented from adhering to the wire 3 again. Therefore, the wire 3 can be colored without any contamination.

Further, since the coloring agent is heated to the temperature lower than the boiling point of the solvent, the solvent is hard to evaporate. Therefore, when spouting the coloring agent, the coloring nozzle 31 for spouting the coloring agent is prevented from being clogged with a high concentration coloring agent. Thus, the wire can be colored reliably by the coloring agent.

The coloring agent supply source 32 is heated and the coloring agent is spouted through the coloring nozzle 31 toward the outer surface 3*a* of the wire 3. Therefore, the coloring nozzle 31 is not heated and the coloring agent is kept at the lower temperature than the boiling point. Therefore, when the coloring agent is spouted, the concentration of the coloring agent is reliably prevented from becoming very high. Therefore, the coloring nozzle 31 can be reliably prevented from being clogged with the coloring agent. Thus, the wire can be colored reliably by the coloring agent.

The coloring agent is stirred by colliding with the end face 50*a* of the second nozzle 50. Further, the first nozzle 37 and the second nozzle 50 are arranged coaxially, while the end face 50*a* is orthogonal to the arrow S. Therefore, the coloring agent is further reliably stirred. Therefore, the concentration of the dye or the pigment in the coloring agent to be spouted is kept even. This prevents the extremely high concentrated coloring agent from adhering to the second nozzle 50.

Further, when entering from the first nozzle 37 into the second nozzle 50, the coloring agent is pressurized rapidly. Therefore, the coloring agent, being spouted from the second nozzle 50 toward the outer surface 3*a* of the wire 3, is ejected vigorously toward the outer surface 3*a*. This prevents the coloring agent from adhering to the second nozzle 50.

Thus, the coloring agent is prevented from adhering to the second nozzle 50, so that the coloring agent is reliably spouted through the second nozzle 50 toward the outer surface 3*a* of the wire 3 with a specific amount of the coloring agent at a time. Further, since the coloring agent is prevented from adhering to the second nozzle 50, it is avoidable that the coloring agent adhering to the second nozzle 50 affects a direction of spouting the coloring agent. Therefore, the coloring agent can be spouted toward a specific position of the outer surface 3*a* of the wire 3 with a specific amount of the coloring agent at a time. Resultingly, the specific position (spot 7 described above) of the outer surface 3*a* of the wire 3 can be colored with a desired color and kept in a specific size.

While the wire 3 is forwarded in the longitudinal direction of the wire 3 relative to the coloring nozzle 31, the coloring nozzle 31 spouts the coloring agent toward the wire 3 with a specific amount of the coloring agent at a time. Thus, the coloring nozzle 31 colors the wire 3, while the wire is forwarded relative to the 31. Therefore, the wire 3 does not need to stop for coloring, so that its workability is not reduced. Further, while the wire 3 is forwarded relative to the coloring nozzle 31, the coloring nozzle 31 spouts toward the wire 3 with a specific amount of the coloring agent. Therefore, optional positions of the wire 3 can be colored continuously.

The encoder 14 measures an information corresponding to the amount of the transfer of the wire 3 and the controller 15 controls the coloring nozzle 31 according to the amount of the transfer of the wire 3. Therefore, the controller 15 shortens a time interval of the spouting of the coloring agent from the coloring nozzle 31 when the transfer speed of the wire 3 increases, while the controller 15 elongates a time interval of the spouting of the coloring agent from the coloring nozzle 31 when the transfer speed of the wire 3 decreases. Thus, if the transfer speed of the wire 3 changes, the controller 15 can keep the spots of the coloring agents adhering to the outer surface 3*a* of the wire 3 in specific intervals.

Thus, if the transfer speed of the wire 3 changes, the controller 15 can make the coloring agents adhere to the outer surface 3*a* of the wire 3 according to a predetermined pattern.

Namely, even if the transfer speed of the wire 3 changes, the controller 15 can color the wire 3 according to a predetermined pattern.

In the following, an apparatus 1 for coloring an electric wire (hereinafter referred to as a coloring apparatus 1) according to a second preferred embodiment of the present invention will be explained with reference to FIG. 3.

Figure 3:
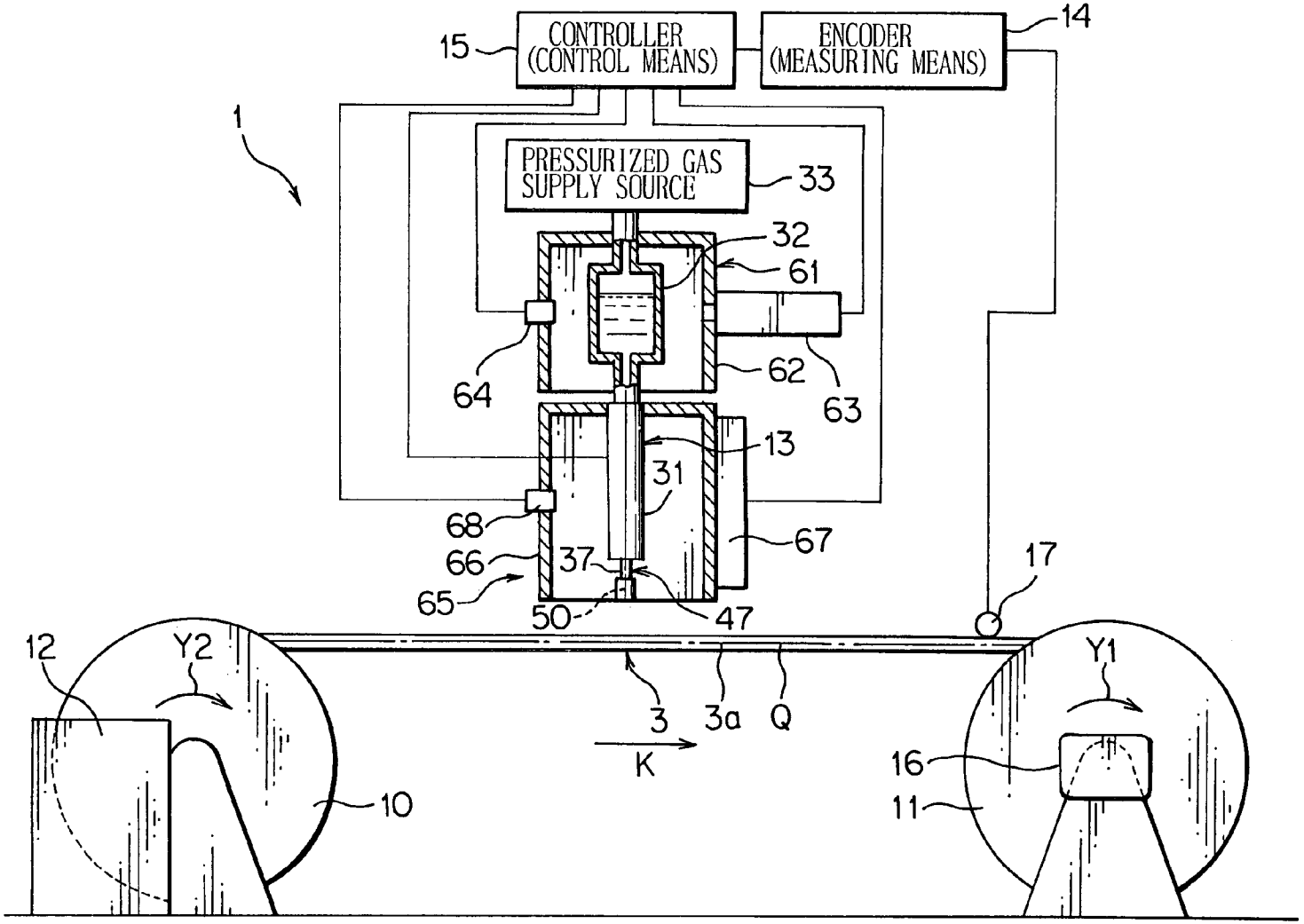
FIG. 3 is an explanatory view showing a structure of an apparatus for coloring an electric wire according to a second embodiment of the present invention.

In this embodiment shown in FIG. 3, the coloring apparatus 1 includes a room temperature retainer 65 as a means to keep a room temperature inside the retainer. As shown in FIG. 3, the room temperature retainer 65 includes a room temperature bath 66, a temperature controller 67 and a temperature sensor 68.

The room temperature bath 66 has a box-like shape with a bottom opening. The room temperature bath 66 receives the coloring nozzle 31. The room temperature bath 66 allows the coloring nozzle 31 to spout the coloring agent toward the outer surface 3*a* of the wire 3. The temperature controller 67 is attached to an outer surface of the room temperature bath 66. The temperature controller 67 cools or heats the room temperature bath 66 by thermoelectric effect so as to keep the inside of the room temperature bath 66 at a room temperature.

The temperature sensor 68 is attached to an outer surface of the room temperature bath 66, and measures a temperature inside the room temperature bath 66. The temperature sensor 68 outputs the temperature inside the room temperature bath 66 to the controller 15.

In the room temperature retainer 65, when the temperature inside the room temperature bath 66 measured by the temperature sensor 68 increases more than a specific temperature higher than a room temperature, the controller 15 makes the temperature controller 67 cool the room temperature bath 66. In the room temperature retainer 65, when the temperature inside the room temperature bath 66 measured by the temperature sensor 68 decreases less than a specific temperature lower than a room temperature, the controller 15 makes the temperature controller 67 heat the room temperature bath 66. Thus, in the room temperature retainer 65, the temperature inside the room temperature bath 66 is kept around a room temperature.

Since the room temperature bath 66 received the coloring nozzle 31 and the temperature controller 67 keeps the room temperature bath 66 at a room temperature, the coloring nozzle 31 is kept at the room temperature in the room temperature retainer 65. Namely, inside the coloring nozzle 31 of the room temperature retainer 65, the coloring nozzle 31 cools the coloring agent previously heated by the heater 61.

In this embodiment, the temperature inside the room temperature bath 66 measured by the temperature sensor 68 is inputted to the controller 15. When the temperature inside the room temperature bath 66 measured by the temperature sensor 68 increases more than a specific temperature higher than a room temperature, the controller 15 makes the temperature controller 67 cool the room temperature bath 66. When the temperature inside the room temperature bath 66 measured by the temperature sensor 68 decreases less than a specific temperature lower than a room temperature, the controller 15 makes the temperature controller 67 heat the room temperature bath 66. Thus, according to the temperature inside the room temperature bath 66 measured by the temperature sensor 68, The controller 15 controls the temperature controller 67 so as to keep the temperature inside the room temperature bath 66 at a room temperature.

When forming the mark 6 on the outer surface 3*a* of the wire 3, namely, coloring the outer surface 3*a* of the wire 3, the coloring apparatus 1 keeps the inside of the room temperature bath 66, namely, the coloring nozzle 31 at a room temperature. For this purpose, the coloring apparatus 1 heats the coloring agent to a range lower than the boiling point of the solvent with the heater 61, and cools the coloring agent with the room temperature retainer 65.

According to this embodiment, by keeping the coloring nozzle 31 at a room temperature, the coloring agent is reliably kept at a temperature lower than the boiling point. Therefore, the solvent of the coloring agent is hard to evaporate, so that the concentration of the coloring agent is prevented from becoming very high when spouted. Therefore, the coloring nozzle 31 is prevented from being clogged with the coloring material. Therefore, the wire 3 can be colored with the coloring agent.

Figure 4:
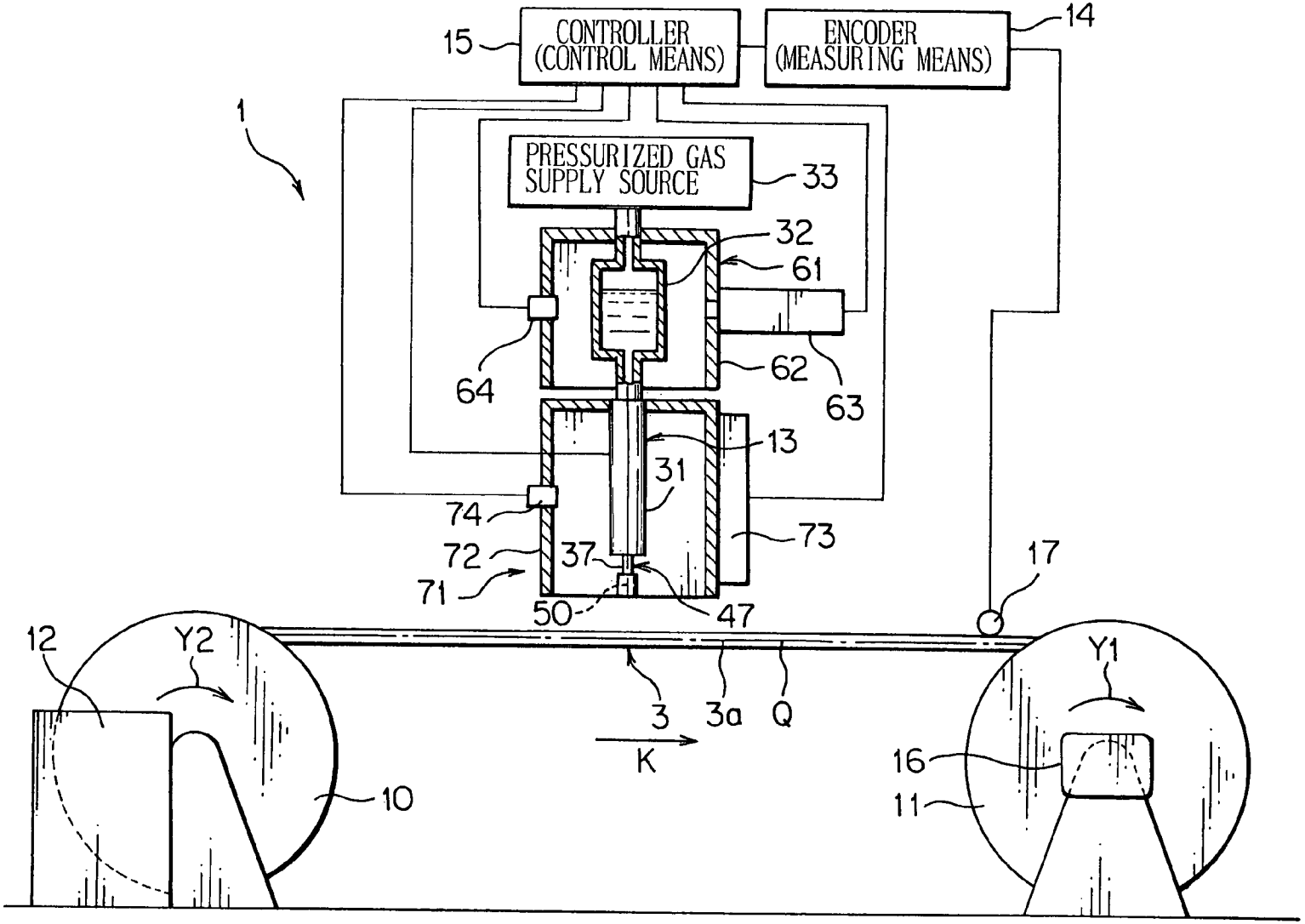
FIG. 4 is an explanatory view showing a structure of an apparatus for coloring an electric wire according to a third embodiment of the present invention.

In the following, an apparatus 1 for coloring an electric wire (hereinafter referred to as a coloring apparatus 1) according to a third preferred embodiment of the present invention will be explained with reference to FIG. 4.

The coloring apparatus 1 of this embodiment includes a cooler 71 as a cooling means. As shown in FIG. 4, the cooler 71 includes a cooling bath 72, a thermoelectric device 73, and a temperature sensor 74.

The cooling bath 72 has a box-like shape with a bottom opening. The cooling bath 72 receives the coloring nozzle 31.

The cooling bath 72 allows the coloring nozzle 31 to spout the coloring agent toward the outer surface 3*a* of the wire 3. The thermoelectric device 73 is attached to an outer surface of the cooling bath 72. The thermoelectric device 73 includes, for example, a well-known Peltier device, and cools the cooling bath 72 by thermoelectric effect.

The temperature sensor 74 is attached to an outer surface of the cooling bath 72, and measures a temperature inside the cooling bath 72. The temperature sensor 74 outputs the temperature inside the cooling bath 72 to the controller 15.

In the cooler 71, when the temperature inside the cooling bath 72 measured by the temperature sensor 74 increases more than a specific temperature higher than a room temperature, the controller 15 makes the thermoelectric device 73 cool the cooling bath 72. In the cooler 71, when the temperature inside the cooling bath 72 measured by the temperature sensor 74 decreases less than a specific temperature lower than a room temperature, the controller 15 makes the thermoelectric device 73 stop cooling the cooling bath 72. Thus, the cooler 71 cools the inside of the cooling bath 72. Therefore, the coloring nozzle 31 and the coloring agent inside the coloring nozzle 31 are cooled.

In this embodiment, the temperature inside the cooling bath 72 measured by the temperature sensor 74 is inputted to the controller 15. When the temperature inside the cooling bath 72 measured by the temperature sensor 74 increases more than a specific temperature higher than a room temperature, the controller 15 makes the thermoelectric device 73 cool the cooling bath 72. When the temperature inside the room cooling bath 72 measured by the temperature sensor 74 decreases less than a specific temperature lower than a room temperature, the controller 15 makes the thermoelectric device 73 stop cooling the cooling bath 72. Thus, according to the temperature inside the cooling bath 72 measured by the temperature sensor 74, The controller 15 controls the thermoelectric device 73 to cool the inside of the cooling bath 72.

When forming the mark 6 on the outer surface 3*a* of the wire 3, namely, coloring the outer surface 3*a* of the wire 3, the coloring apparatus 1 cools the inside of the cooling bath 72, namely, the coloring nozzle 31 at a room temperature. For this purpose, the coloring apparatus 1 heats the coloring agent to a range lower than the boiling point of the solvent with the heater 61, and cools the coloring agent with cooler 71.

According to this embodiment, by cooling the coloring nozzle 31 at a room temperature, the coloring agent is reliably kept at a temperature lower than the boiling point. Therefore, the solvent of the coloring agent is hard to evaporate, so that the concentration of the coloring agent is prevented from becoming very high when spouted. Therefore, the coloring nozzle 31 is prevented from being clogged with the coloring material. Therefore, the wire 3 can be colored with the coloring agent.

In the present invention, as the coloring liquid or coating material, various material may be used, such as acrylic coating material, ink (dye or pigment) and UV-ink.

The aforementioned preferred embodiments are described to aid in understanding the present invention and variations may be made by one skilled in the art without departing from the spirit and scope of the present invention.

What is claimed is:

1. A method of coloring an electric wire comprising the step of:

spouting a liquid coloring agent including a coloring material and a solvent, by ejecting the liquid coloring agent in liquid drop form, toward an outer surface of the electric wire with a specific amount thereof at a time so as to allow a liquid drop of the coloring agent to adhere to the outer surface of the electric wire so as to form a plurality of spots arranged in a longitudinal direction of the electric wire, and provide a predetermined distance between centers of spots situated adjacently to each other, whereby said coloring agent is previously heated up to a range lower than a boiling point of the solvent, and then spouted to the outer surface of the electric wire, wherein a receiver for receiving the coloring agent therein is heated for heating the coloring agent to a range lower than the boiling point of the solvent, wherein temperature of the coloring agent is monitored by a temperature sensor, and maintained in a liquid state, wherein the liquid coloring agent is passed from the receiver to a first nozzle and then to a coaxial second nozzle, while being pressurized, and spouted from the second nozzle toward the outer surface of the electric wire, and wherein a coloring agent supply source and the coloring nozzles are respectively independently heated.

2. The method of coloring an electric wire as claimed in claim 1, wherein a heating bath receiving the receiver is heated by hot air.

3. The method of coloring an electric wire as described in claim 1, wherein the nozzle is kept at a room temperature by heating or cooling a room temperature bath.

4. The method of coloring an electric wire as described in claim 3, wherein the nozzle is cooled by cooling a cooling bath.

* * * * *